US008384639B2

(12) United States Patent
Takahashi et al.

(10) Patent No.: US 8,384,639 B2
(45) Date of Patent: Feb. 26, 2013

(54) LIQUID CRYSTAL DISPLAY DEVICE AND METHOD FOR EMPHASIZING TEMPORAL SIGNAL CHANGE ON A VIDEO SIGNAL BASED ON AT LEAST A POLARITY FOR THE VIDEO SIGNAL

(75) Inventors: Kozo Takahashi, Tokyo (JP); Asahi Yamato, Tokyo (JP); Kiyoshi Nakagawa, Yokohama (JP); Takaaki Kawai, Tsu (JP)

(73) Assignee: Sharp Kabushiki Kaisha, Osaka (JP)

( * ) Notice: Subject to any disclaimer, the term of this patent is extended or adjusted under 35 U.S.C. 154(b) by 760 days.

(21) Appl. No.: 12/086,055

(22) PCT Filed: Oct. 25, 2006

(86) PCT No.: PCT/JP2006/321217

§ 371 (c)(1),
(2), (4) Date: Jun. 5, 2008

(87) PCT Pub. No.: WO2007/091353

PCT Pub. Date: Aug. 16, 2007

(65) Prior Publication Data

US 2009/0267884 A1 Oct. 29, 2009

(30) Foreign Application Priority Data

Feb. 7, 2006 (JP) ..... 2006-029894

(51) Int. Cl.
*G09G 3/36* (2006.01)

(52) U.S. Cl. ..... 345/96

(58) Field of Classification Search ..... 345/87–104, 345/204, 209, 215, 54
See application file for complete search history.

(56) References Cited

U.S. PATENT DOCUMENTS

| | | | | |
|---|---|---|---|---|
| 6,057,821 | A | 5/2000 | Hughes et al. | |
| 2001/0038372 | A1 | 11/2001 | Lee | |
| 2002/0044126 | A1 | 4/2002 | Aoki | |
| 2003/0048247 | A1 * | 3/2003 | Ham | 345/87 |
| 2003/0197672 | A1 * | 10/2003 | Yun et al. | 345/99 |

(Continued)

FOREIGN PATENT DOCUMENTS

| | | |
|---|---|---|
| JP | 60140323 A | 7/1985 |
| JP | 02-184891 | 7/1990 |

(Continued)

OTHER PUBLICATIONS

English translation of Japanese Office Action dated Oct. 18, 2011 in corresponding Japanese Application No. 2007-557740.

*Primary Examiner* — Liliana Cerullo
(74) *Attorney, Agent, or Firm* — Harness, Dickey & Pierce

(57) ABSTRACT

A drive circuit of a liquid crystal display device performs line inversion drive based on a correction video signal V. A look-up table (12) includes two types of tables having stored therein correction values for use in overshoot drive. Based on a current-frame video signal X, a previous-frame video signal Y stored in a frame memory (11), and a polarity-reversing signal REV, a correction process portion (13) reads a correction value from the look-up table (12), and outputs the correction value being read as the correction video signal V. In such a manner, a correcting circuit (10) is used to control the degree of overshoot in accordance with the polarity-reversing signal REV. Thus, it is possible to suitably control the change in pixel brightness regardless of the polarity of the applied voltage, thereby preventing any fringes from being generated while displaying moving images.

7 Claims, 15 Drawing Sheets

U.S. PATENT DOCUMENTS

| | | | | |
|---|---|---|---|---|
| 2006/0125748 | A1 * | 6/2006 | Yang et al. | 345/88 |
| 2007/0171163 | A1 * | 7/2007 | Miyata | 345/87 |

FOREIGN PATENT DOCUMENTS

| | | | |
|---|---|---|---|
| JP | 04-142513 | A | 5/1992 |
| JP | 04-288589 | | 10/1992 |
| JP | 10-054972 | | 2/1998 |
| JP | 2001-265298 | | 9/2001 |
| JP | 2002-182623 | | 6/2002 |
| JP | 2004-078129 | | 3/2004 |
| WO | WO 2005/111981 | A1 | 11/2005 |

* cited by examiner

*Fig. 2A*

| X \ Y | 0 | 1 | 2 | ··· | 255 |
|---|---|---|---|---|---|
| 0 | $P_{0,0}$ | $P_{0,1}$ | $P_{0,2}$ | | $P_{0,255}$ |
| 1 | $P_{1,0}$ | $P_{1,1}$ | $P_{1,2}$ | | $P_{1,255}$ |
| 2 | $P_{2,0}$ | $P_{2,1}$ | $P_{2,2}$ | | $P_{2,255}$ |
| ⋮ | | | | ⋱ | |
| 255 | $P_{255,0}$ | $P_{255,1}$ | $P_{255,2}$ | | $P_{255,255}$ |

*Fig. 2B*

| X \ Y | 0 | 1 | 2 | ··· | 255 |
|---|---|---|---|---|---|
| 0 | $N_{0,0}$ | $N_{0,1}$ | $N_{0,2}$ | | $N_{0,255}$ |
| 1 | $N_{1,0}$ | $N_{1,1}$ | $N_{1,2}$ | | $N_{1,255}$ |
| 2 | $N_{2,0}$ | $N_{2,1}$ | $N_{2,2}$ | | $N_{2,255}$ |
| ⋮ | | | | ⋱ | |
| 255 | $N_{255,0}$ | $N_{255,1}$ | $N_{255,2}$ | | $N_{255,255}$ |

*Fig. 3*

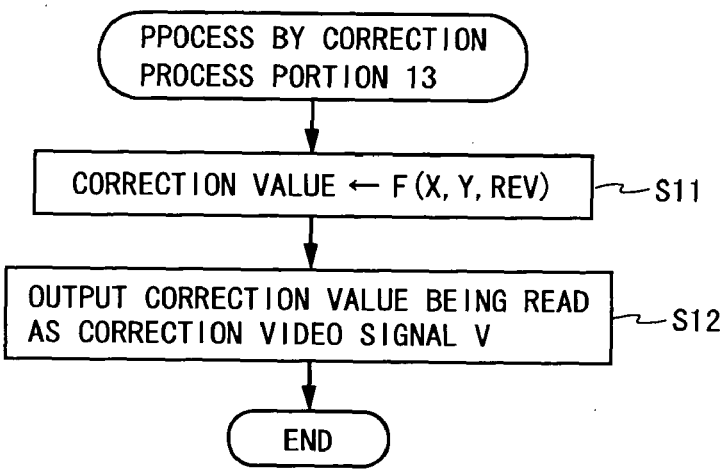

*Fig. 4*

| | 7 | 8 |
|---|---|---|
| 4 | -L1 → +L2<br>INSUFFICIENT CHANGE<br>OVERSHOOT:LARGE | -L1 → +L2<br>INSUFFICIENT CHANGE<br>OVERSHOOT:LARGE |
| 5 | +L1 → -L2<br>EXCESSIVE CHANGE<br>OVERSHOOT:SMALL | +L1 → -L2<br>EXCESSIVE CHANGE<br>OVERSHOOT:SMALL |
| 6 | -L1 → +L2<br>INSUFFICIENT CHANGE<br>OVERSHOOT:LARGE | -L1 → +L2<br>INSUFFICIENT CHANGE<br>OVERSHOOT:LARGE |
| 7 | +L1 → -L2<br>EXCESSIVE CHANGE<br>OVERSHOOT:SMALL | +L1 → -L2<br>EXCESSIVE CHANGE<br>OVERSHOOT:SMALL |

*Fig. 7A*

| | Y | 0~31 | 32~63 | 64~95 | ··· | 224~255 |
|---|---|---|---|---|---|---|
| X | x \ y | 0 | 1 | 2 | ··· | 7 |
| 0~7 | 0 | $P_{0,0}$ | $P_{0,1}$ | $P_{0,2}$ | | $P_{0,7}$ |
| 8~15 | 1 | $P_{1,0}$ | $P_{1,1}$ | $P_{1,2}$ | | $P_{1,7}$ |
| 16~23 | 2 | $P_{2,0}$ | $P_{2,1}$ | $P_{2,2}$ | | $P_{2,7}$ |
| ⋮ | ⋮ | | | | ⋱ | |
| 248~255 | 31 | $P_{31,0}$ | $P_{31,1}$ | $P_{31,2}$ | | $P_{31,7}$ |

*Fig. 7B*

| | Y | 0~31 | 32~63 | 64~95 | ··· | 224~255 |
|---|---|---|---|---|---|---|
| X | x \ y | 0 | 1 | 2 | ··· | 7 |
| 0~7 | 0 | $N_{0,0}$ | $N_{0,1}$ | $N_{0,2}$ | | $N_{0,7}$ |
| 8~15 | 1 | $N_{1,0}$ | $N_{1,1}$ | $N_{1,2}$ | | $N_{1,7}$ |
| 16~23 | 2 | $N_{2,0}$ | $N_{2,1}$ | $N_{2,2}$ | | $N_{2,7}$ |
| ⋮ | ⋮ | | | | ⋱ | |
| 248~255 | 31 | $N_{31,0}$ | $N_{31,1}$ | $N_{31,2}$ | | $N_{31,7}$ |

*Fig. 15A*

| | 1 | 2 | 3 | 4 | 5 | 6 | 7 | 8 | 9 |
|---|---|---|---|---|---|---|---|---|---|
| 1 | +L1 | +L1 | +L1 | +L1 | +L1 | +L1 | +L1 | +L1 | +L1 |
| 2 | −L1 | −L1 | −L1 | −L1 | −L1 | −L1 | −L1 | −L1 | −L1 |
| 3 | +L1 | +L1 | +L1 | +L1 | +L1 | +L1 | +L1 | +L1 | +L1 |
| 4 | −L1 | −L2 | −L2 | −L2 | −L2 | −L2 | −L1 | −L1 | −L1 |
| 5 | +L1 | +L2 | +L2 | +L2 | +L2 | +L2 | +L1 | +L1 | +L1 |
| 6 | −L1 | −L2 | −L2 | −L2 | −L2 | −L2 | −L1 | −L1 | −L1 |
| 7 | +L1 | +L2 | +L2 | +L2 | +L2 | +L2 | +L1 | +L1 | +L1 |
| 8 | −L1 | −L1 | −L1 | −L1 | −L1 | −L1 | −L1 | −L1 | −L1 |
| 9 | +L1 | +L1 | +L1 | +L1 | +L1 | +L1 | +L1 | +L1 | +L1 |
| 10 | −L1 | −L1 | −L1 | −L1 | −L1 | −L1 | −L1 | −L1 | −L1 |
| 11 | +L1 | +L1 | +L1 | +L1 | +L1 | +L1 | +L1 | +L1 | +L1 |

*Fig. 15B*

| | 1 | 2 | 3 | 4 | 5 | 6 | 7 | 8 | 9 |
|---|---|---|---|---|---|---|---|---|---|
| 1 | −L1 | −L1 | −L1 | −L1 | −L1 | −L1 | −L1 | −L1 | −L1 |
| 2 | +L1 | +L1 | +L1 | +L1 | +L1 | +L1 | +L1 | +L1 | +L1 |
| 3 | −L1 | −L1 | −L1 | −L1 | −L1 | −L1 | −L1 | −L1 | −L1 |
| 4 | +L1 | +L1 | +L1 | +L2 | +L2 | +L2 | +L2 | +L2 | +L1 |
| 5 | −L1 | −L1 | −L1 | −L2 | −L2 | −L2 | −L2 | −L2 | −L1 |
| 6 | +L1 | +L1 | +L1 | +L2 | +L2 | +L2 | +L2 | +L2 | +L1 |
| 7 | +L1 | +L1 | +L1 | −L2 | −L2 | −L2 | −L2 | −L2 | −L1 |
| 8 | +L1 | +L1 | +L1 | +L1 | +L1 | +L1 | +L1 | +L1 | +L1 |
| 9 | −L1 | −L1 | −L1 | −L1 | −L1 | −L1 | −L1 | −L1 | −L1 |
| 10 | +L1 | +L1 | +L1 | +L1 | +L1 | +L1 | +L1 | +L1 | +L1 |
| 11 | −L1 | −L1 | −L1 | −L1 | −L1 | −L1 | −L1 | −L1 | −L1 |

| | 7 | 8 |
|---|---|---|
| 4 | −L1 → +L2<br>INSUFFICIENT CHANGE<br>DARK | −L1 → +L2<br>INSUFFICIENT CHANGE<br>DARK |
| 5 | +L1 → −L2<br>EXCESSIVE CHANGE<br>BRIGHT | +L1 → −L2<br>EXCESSIVE CHANGE<br>BRIGHT |
| 6 | −L1 → +L2<br>INSUFFICIENT CHANGE<br>DARK | −L1 → +L2<br>INSUFFICIENT CHANGE<br>DARK |
| 7 | +L1 → −L2<br>EXCESSIVE CHANGE<br>BRIGHT | +L1 → −L2<br>EXCESSIVE CHANGE<br>BRIGHT |

LIQUID CRYSTAL DISPLAY DEVICE AND METHOD FOR EMPHASIZING TEMPORAL SIGNAL CHANGE ON A VIDEO SIGNAL BASED ON AT LEAST A POLARITY FOR THE VIDEO SIGNAL

TECHNICAL FIELD

The present invention relates to liquid crystal display devices, and particularly to a liquid crystal display device that performs line inversion drive, and a method for driving the same.

BACKGROUND ART

When a voltage with the same polarity is continuously applied to pixels, liquid crystal display devices might suffer some failure, such as burn-in, and therefore they employ drive methods in which the polarity of the voltage applied to the pixels is changed every predetermined period. Examples of the methods used include frame inversion drive in which the voltage polarity is changed every frame, line inversion drive in which the voltage polarity is changed every line or every several lines, and dot inversion drive in which the voltage polarity is changed for each pixel. Also, in order to improve response speed, some liquid crystal display devices perform overshoot drive (also referred to as "overdrive" or "overdriving"), applying a voltage higher or lower than the voltage that should be applied to pixels based on a video signal for the current frame and a video signal for the previous frame.

FIG. 13 is a block diagram illustrating the configuration of a conventional liquid crystal display device that performs line inversion drive and overshoot drive. In FIG. 13, a correcting circuit 90 includes a frame memory 91, a look-up table 92, and a correction process portion 93. The frame memory 91 stores a video signal of one frame, and the look-up table 92 has stored therein correction values emphasizing temporal signal change. Based on a video signal X for the current frame supplied from a signal source S and a video signal Y for the previous frame stored in the frame memory 91, the correction process portion 93 reads a correction value from the look-up table 92, and outputs the correction value being read as a correction video signal V.

A display control circuit 1, a scanning signal line drive circuit 2, and a data signal line drive circuit 3 drive scanning signal lines G1 to Gn and data signal lines S1 to Sm based on the correction video signal V, and a control signal C1 supplied from the signal source S by way of the correcting circuit 90, thereby performing line inversion drive on a pixel array 5 including pixels 6. A common electrode drive circuit 4 applies a common electrode voltage Vcom to a common electrode 7 provided in the pixel array 5.

Referring to FIGS. 14A to 14D, effects of overshoot drive will be described. FIGS. 14A to 14D show changes of the voltage applied to the pixels and changes in pixel intensity in the case where the intensity is increased from an initial value Li to a target value Lt within one frame period from time t1 to time t2. When overshoot drive is not performed, a voltage Vt corresponding to the target value Lt for the intensity is applied to the pixels during the period from time t1 to time t2 (FIG. 14A). Accordingly, the intensity approximates the target value Lt at a certain speed (FIG. 14B). However, depending on the combination of the initial value Li and the target value Lt for the intensity, the intensity might not reach the target value Lt within one frame period. At time t2 in the example shown in FIG. 14B, the intensity only reaches a level that is lower than the target value Lt by ΔL.

On the other hand, when overshoot drive is performed, a voltage Vo higher than the voltage Vt is applied to the pixels during the period from time t1 to time t2 (FIG. 14C). Accordingly, the intensity approximates the target value Lt at a higher speed than when overshoot drive is not performed (FIG. 14D). Therefore, by applying a voltage at a suitable level in accordance with the combination of the initial value Li and the target value Lt for the intensity, it becomes possible to allow the intensity to reach the target value Lt within one frame period. At time t2 in the example shown in FIG. 14D, the intensity coincides with the target value Lt. Note that when the target value for the intensity is lower than the initial value, a voltage lower than the voltage corresponding to the target value for the intensity is applied to the pixels.

Overshoot drive is disclosed in, for example, Patent Document 1. In addition, Patent Document 2 discloses technology for passive-matrix liquid crystal display devices having their response speeds changed according to the polarity of an applied voltage, in which two types of signals are used to generate a pixel signal for maximizing a torque applied to liquid crystal molecules during switching.

[Patent Document 1] Japanese Laid-Open Patent Publication No. 2001-265298

[Patent Document 2] Japanese Laid-Open Patent Publication No. 10-54972

DISCLOSURE OF THE INVENTION

Problems to be Solved by the Invention

However, conventional liquid crystal display devices that perform line inversion drive have a problem where bright and dark fringes are generated on the display screen while displaying moving images due to the polarity of the applied voltage being changed line by line.

For example, consider a case where the display screen of a normally-black liquid crystal display device transitions from the state shown in FIG. 15A to the state shown in FIG. 15B after one frame period. In FIGS. 15A and 15B, rectangles labeled "+L1" represent pixels to which a voltage with positive polarity has been applied to control the intensity to be maintained at L1 based on a video signal of tone N1, and rectangles labeled "+L2" represent pixels to which a voltage with positive polarity has been applied to control the intensity to be maintained at L2 based on a video signal of tone N2. In addition, rectangles labeled "−L1" represent pixels to which a voltage with negative polarity has been applied to control the intensity to be maintained at L1 based on the video signal of tone N1, and rectangles labeled "−L2" represent pixels to which a voltage with negative polarity has been applied to control the intensity to be maintained at L2 based on the video signal of tone N2. Note that the intensity L2 is brighter than the intensity L1. FIGS. 15A and 15B show a rectangular area of 5×4 pixels brighter than the background moving to the right by two pixels.

FIG. 16 is a diagram showing the tendency of pixel brightness for a portion of the pixels within the display screen as shown in FIGS. 15A and 15B (the pixels in the fourth to seventh rows and the seventh and eighth columns). A voltage for changing the pixel brightness from the intensity L1 to the intensity L2 is applied to all the eight pixels shown in FIG. 16. However, in the case of conventional liquid crystal display devices that perform line inversion drive, even if voltages that change by the same amount in order to change the pixel brightness by the same level are applied, the amount of change in pixel brightness varies between the pixels to which the voltage with positive polarity has been applied and the pixels to which the voltage with negative polarity has been applied (the reason for this will be described later). Therefore, in the example shown in FIG. 16, the intensity of the pixels in the even-numbered rows to which the voltage with positive polarity has been applied is darker than the intensity of the pixels in the odd-numbered rows to which the voltage with negative polarity has been applied.

As a result, the eight pixels shown in FIG. 16 form bright and dark fringes including relatively dark portions consisting of the pixels to which the voltage with positive polarity has been applied and relatively bright portions consisting of the pixels to which the voltage with negative polarity has been applied. Similarly, the pixels in the fourth to seventh rows and the second and third columns form bright and dark fringes including relatively dark portions consisting of the pixels to which the voltage with positive polarity has been applied and relatively bright portions consisting of the pixels to which the voltage with negative polarity has been applied. These fringes are generated while the rectangular area brighter than the background is moving. Note that similar fringes are also generated while any rectangular area darker than the background is moving. In such a manner, in the case of conventional liquid crystal display devices that perform line inversion drive, the bright and dark fringes are generated on the display screen while displaying moving images, resulting in reduced display quality.

The following is the reason why the amount of change in pixel brightness in conventional liquid crystal display devices that perform line inversion drive varies between the pixels to which the voltage with positive polarity has been applied and the pixels to which the voltage with negative polarity has been applied. In liquid crystal display devices, voltages supplied from outside pixels drop within the pixels due to pull-in. In addition, in the case of general liquid crystal display devices, the closer the applied voltage approximates zero, the greater the amount of pull-in (the amount of voltage drop due to pull-in) becomes. Accordingly, when determining the voltage to be supplied, it is necessary to add the amount of pull-in to the applied voltage in accordance with the level of the applied voltage. For example, in the case of normally-black liquid crystal display devices, a large amount of pull-in is added to the applied voltage when the absolute value of the applied voltage is low and thus pixels appear dark, whereas a small amount of pull-in is added to the applied voltage when the absolute value of the applied voltage is high and thus pixels appear bright (see FIG. 17).

In the case of conventional liquid crystal display devices, if the applied voltages have the same absolute value, the same amount of pull-in is added to the applied voltages regardless of the polarities of the applied voltages. Accordingly, for example, in the case of normally-black liquid crystal display devices, when attempting to brighten pixels, the amount of pull-in is underestimated, deeming the pixels to be bright although they are actually dark, but in this case, the applied voltage with positive polarity based on the underestimated amount of pull-in does not sufficiently change the pixel brightness (the pixels appear darker than when the amount of pull-in is correctly estimated), whereas the applied voltage with negative polarity based on the underestimated amount of pull-in excessively changes the pixel brightness (the pixels appear brighter than when the amount of pull-in is correctly estimated). In addition, when attempting to darken pixels, the amount of pull-in is overestimated, deeming the pixels to be dark although they are actually bright, but in this case, the applied voltage with positive polarity based on the overestimated amount of pull-in does not sufficiently change the pixel brightness (the pixels appear brighter than when the amount of pull-in is correctly estimated), whereas the applied voltage with negative polarity based on the overestimated amount of pull-in excessively changes the pixel brightness (the pixels appear darker than when the amount of pull-in is correctly estimated).

On the other hand, in the case of normally-white liquid crystal display devices, when attempting to darken pixels, the amount of pull-in is underestimated, but in this case, the applied voltage with positive polarity based on the underestimated amount of pull-in does not sufficiently change the pixel brightness (the pixels appear brighter than when the amount of pull-in is correctly estimated), whereas the applied voltage with negative polarity based on the underestimated amount of pull-in excessively changes the pixel brightness (the pixels appear darker than when the amount of pull-in is correctly estimated). In addition, when attempting to brighten pixels, the amount of pull-in is overestimated, but in this case, the applied voltage with positive polarity based on the overestimated amount of pull-in does not sufficiently change the pixel brightness (the pixels appear darker than when the amount of pull-in is correctly estimated), whereas the applied voltage with negative polarity based on the overestimated amount of pull-in excessively changes the pixel brightness (the pixels appear brighter than when the amount of pull-in is correctly estimated). In such a manner, in the case of conventional liquid crystal display devices that perform line inversion drive, depending on the polarity of the applied voltage, the pixel brightness might not be sufficiently changed or might be excessively changed compared to the case where the amount of pull-in is correctly estimated, and therefore the amount of change in pixel brightness varies between the pixels to which the voltage with positive polarity has been applied and the pixels to which the voltage with negative polarity has been applied.

Note that the above-described variations of the change in pixel brightness, and the bright and dark fringes due to such variations may occur in both cases where overshoot drive is performed and where overshoot drive is not performed, but they are more noticeable in the former case.

Therefore, an objective of the present invention is to prevent any fringes from being generated while displaying moving images in liquid crystal display devices that perform line inversion drive.

Solution to the Problems

A first aspect of the present invention is directed to a liquid crystal display device that performs line inversion drive, comprising:

a pixel array including a plurality of pixels disposed in row and column directions, a plurality of scanning signal lines each commonly connected to the pixels disposed in the same row, and a plurality of data signal lines each commonly connected to the pixels disposed in the same column;

a correcting circuit for obtaining a correction video signal by performing correction for emphasizing temporal signal change on a video signal supplied from a signal source;

a scanning signal line drive circuit for sequentially selecting and activating the scanning signal lines; and a data signal line drive circuit for applying a voltage corresponding to the correction video signal to the data signal lines, while changing its polarity every predetermined number of line periods, wherein the correcting circuit differentially performs the correction in accordance with the polarity of the voltage applied to the data signal lines.

In a second aspect of the present invention, based on the first aspect of the invention, the correcting circuit includes:

a storage portion for storing a video signal of at least one frame;

a conversion table having stored therein correction values emphasizing the temporal signal change in association with combinations of values for the video signal, as well as voltage polarities; and a correction process portion for reading a correction value from the conversion table and outputting the correction value being read as the correction video signal based on a current-frame video signal supplied from the signal source, a previous-frame video signal stored in the storage portion, and the polarity of the voltage applied to the data signal lines.

In a third aspect of the present invention, based on the first aspect of the invention, the correcting circuit includes:

a storage portion for storing a video signal of at least one frame;

a conversion table having stored therein correction values emphasizing the temporal signal change in association with combinations of value ranges for the video signal, as well as voltage polarities; and a correction process portion for reading a correction value from the conversion table and outputting a result obtained by subjecting the correction value being read to a predetermined operation as the correction video signal, based on a current-frame video signal supplied from the signal source, a previous-frame video signal stored in the storage portion, and the polarity of the voltage applied to the data signal lines.

In a fourth aspect of the present invention, based on the first aspect of the invention, the correcting circuit includes:

a storage portion for storing a video signal of at least one frame; and a correction process portion for performing a correcting operation to emphasize the temporal signal change based on a current-frame video signal supplied from the signal source and a previous-frame video signal stored in the storage portion, and the correction process portion differentially performs the correcting operation in accordance with the polarity of the voltage applied to the data signal lines.

In a fifth aspect of the present invention, based on the first aspect of the invention, there is further comprised a display control circuit for outputting a control signal to the scanning signal line drive circuit and the data signal line drive circuit, and the correcting circuit differentially performs the correction in accordance with a polarity-reversing signal outputted from the display control circuit to the data signal line drive circuit.

In a sixth invention of the present invention, based on the first aspect of the invention, the correcting circuit differentially performs the correction in accordance with a polarity-reversing signal supplied from the signal source, along with the video signal.

In a seventh aspect of the present invention, based on the first aspect of the invention, when the polarity of the voltage applied to the data signal line is positive, the correcting circuit performs the correction so as to emphasize the temporal signal change more than when the polarity of the voltage is negative.

An eighth aspect of the present invention is directed to a method for driving a liquid crystal display device provided with a pixel array including a plurality of pixels disposed in row and column directions, a plurality of scanning signal lines each commonly connected to the pixels disposed in the same row, and a plurality of data signal lines each commonly connected to the pixels disposed in the same column, the method comprising the steps of:

obtaining a correction video signal by performing correction for emphasizing temporal signal change on a video signal supplied from a signal source; sequentially selecting and activating the scanning signal lines; and applying a voltage corresponding to the correction video signal to the data signal lines, while changing its polarity every predetermined number of line periods, wherein in the step of obtaining a correction video signal, the correction is differentially performed in accordance with the polarity of the voltage applied to the data signal lines.

Effect of the Invention

According to the first or eighth aspect of the present invention, the correction is differentially performed in accordance with the polarity of the voltage applied to the data signal lines, and therefore it is possible to suitably control the change in pixel brightness regardless of the polarity of the applied voltage, thereby preventing any fringes from being generated while displaying moving images. Thus, it is possible to prevent any reduction in quality of the moving images being displayed.

According to the second aspect of the present invention, there is provided the correction process portion for reading the correction value from the conversion table and outputting it as the correction video signal, and therefore it is possible to prevent any fringes from being generated while displaying moving images with a simple circuit configuration.

According to the third aspect of the present invention, there are provided the conversion table having the correction values stored therein in association with combinations of value ranges for the video signal, and the correction process portion for subjecting the correction value being read from the conversion table to a predetermined operation and outputting it as the correction video signal, and therefore it is possible to prevent any fringes from being generated while displaying moving images, although the size of the conversion table is reduced.

According to the fourth aspect of the present invention, there is provided the correction process portion for differentially performing the correcting operation in accordance with the polarity of the applied voltage, and therefore it is possible to prevent any fringes from being generated while displaying moving images without using any conversion table.

According to the fifth or sixth aspect of the present invention, the correcting circuit differentially performs the correction in accordance with the polarity-reversing signal supplied from the display control circuit or the signal source, and therefore it is possible to prevent any fringes from being generated while displaying moving images with a simple circuit configuration.

According to the seventh aspect of the present invention, for the pixels to which the voltage with positive polarity is applied so that their brightness does not change sufficiently, the degree of overshoot is intensified to compensate for the change in brightness, whereas for the pixels to which the voltage with negative polarity is applied so that their brightness changes excessively, the degree of overshoot is reduced to keep down the change in brightness. In such a manner, the correction is differentially performed in accordance with the polarity of the voltage applied to the data signal lines, and therefore it is possible to suitably control the change in pixel brightness regardless of the polarity of the applied voltage, thereby preventing any fringes from being generated while displaying moving images.

BRIEF DESCRIPTION OF THE DRAWINGS

FIG. 2A is a diagram showing a configuration example of a positive polarity table shown in FIG. 1.

FIG. 2B is a diagram showing a configuration example of a negative polarity table shown in FIG. 1.

FIG. 3 is a flowchart illustrating a process by a correction process portion shown in FIG. 1.

FIG. 4 is a diagram for describing effects of the liquid crystal display device shown in FIG. 1.

FIG. 7A is a diagram showing a configuration example of a positive polarity table shown in FIG. 6.

FIG. 7B is a diagram showing a configuration example of a negative polarity table shown in FIG. 6.

FIG. 15A is a diagram illustrating an exemplary display screen of a conventional liquid crystal display device, in which fringes are generated.

FIG. 15B is a diagram illustrating the display screen one frame period after that shown in FIG. 15A.

DESCRIPTION OF THE REFERENCE CHARACTERS

Figure 1:
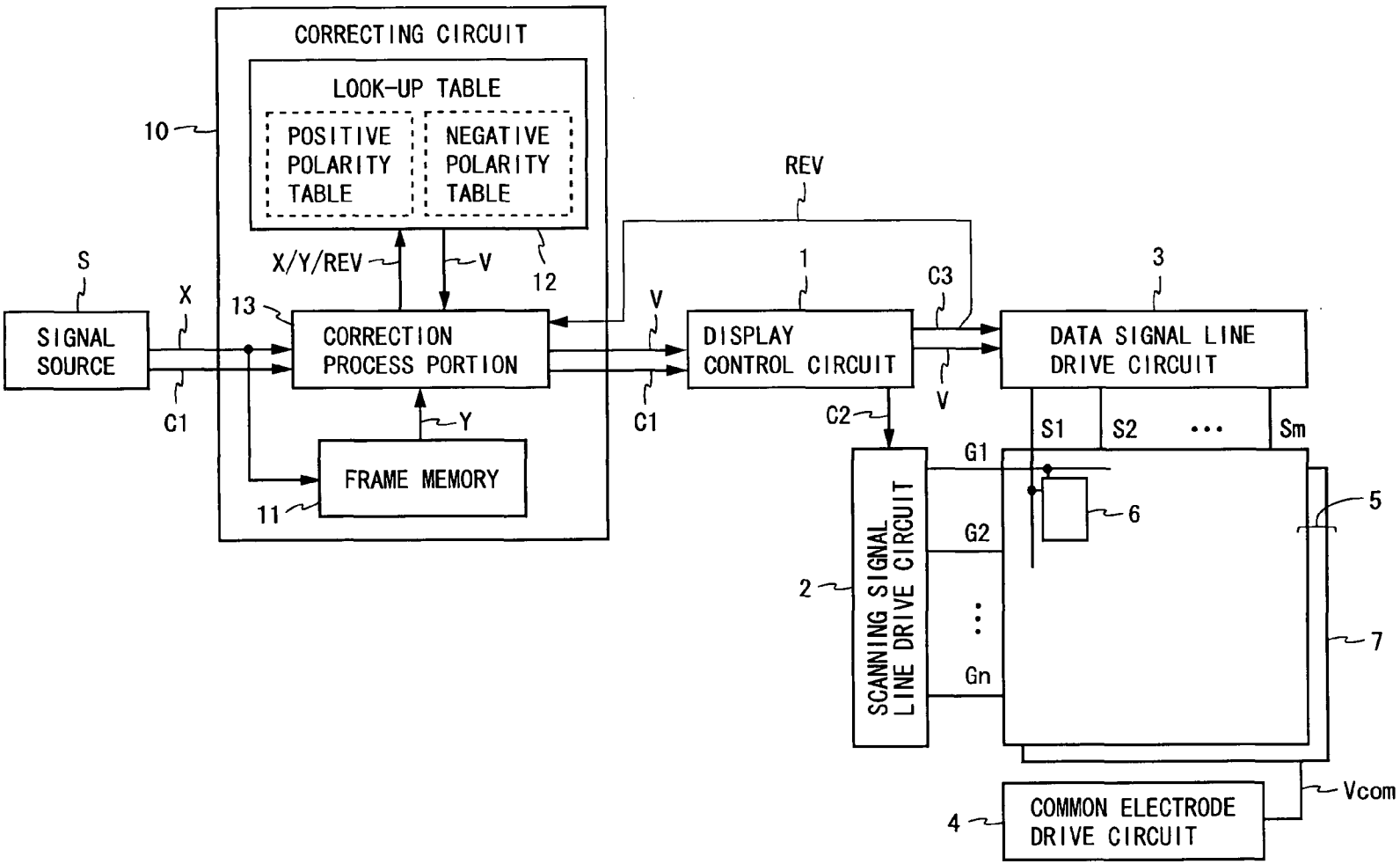
FIG. 1 is a block diagram illustrating the configuration of a liquid crystal display device according to a first embodiment of the present invention.

X current-frame video signal
Y previous-frame video signal
V correction video signal
1, 8 display control circuit
2 scanning signal line drive circuit
3 data signal line drive circuit
4 common electrode drive circuit
5 pixel array
6 pixel
7 common electrode
10, 15, 20, 30 correcting circuit
11 frame memory
12, 22 look-up table
13, 16, 23, 33 correction process portion
41, 45, 51 main unit
42, 46, 52 liquid crystal display module
53 table storage portion

BEST MODE FOR CARRYING OUT THE INVENTION (First Embodiment)

FIG. 1 is a block diagram illustrating the configuration of a liquid crystal display device according to a first embodiment of the present invention. The liquid crystal display device shown in FIG. 1 includes a correcting circuit 10, a display control circuit 1, a scanning signal line drive circuit 2, a data signal line drive circuit 3, a common electrode drive circuit 4, and a pixel array 5. This liquid crystal display device displays a screen by performing line inversion drive and overshoot drive. The following description will be given on the assumption that the liquid crystal display device shown in FIG. 1 is a normally-black liquid crystal display device.

In FIG. 1, a signal source S is provided outside the liquid crystal display device, and supplies a video signal X and a control signal C1 to the liquid crystal display device. The control signal C1 includes a clock signal CK, a horizontal synchronization signal HSYNC, a vertical synchronization signal VSYNC, etc. The correcting circuit 10 is provided to perform overshoot drive. The correcting circuit 10 performs a predetermined correction process (the details of which will be described later) on the video signal X in accordance with the control signal C1, thereby obtaining a correction video signal V.

The pixel array 5 has a structure in which a liquid crystal material is provided between two glass substrates. Provided on one of the glass substrates are (m×n) pixels 6 (where m and n are integers of 1 or higher), scanning signal lines G1 to Gn, and data signal lines S1 to Sm. The pixels 6 are disposed such that m pixels are arranged in the row direction, and n pixels are arranged in the column direction. The scanning signal lines G1 to Gn are each commonly connected to the pixels 6 disposed in the same row. The data signal lines S1 to Sm are each commonly connected to the pixels 6 disposed in the same column. Formed on the other glass substrate is a common electrode 7 provided in a position opposed to all the pixels 6.

The display control circuit 1 receives the correction video signal V, along with the control signal C1 supplied from the signal source S by way of the correcting circuit 10. Based on the control signal C1, the display control circuit 1 outputs a control signal C2 and a control signal C3 to the scanning signal line drive circuit 2 and the data signal line drive circuit 3, respectively. The control signal C2 includes a gate clock GCK, a gate start pulse GSP, etc., and the control signal C3 includes a source clock SCK, a source start pulse SSP, a polarity-reversing signal REV, etc. In addition, the display control circuit 1 outputs the correction video signal V to the data signal line drive circuit 3 in accordance with the timing of outputting the control signal C3.

The scanning signal line drive circuit 2 sequentially selects and activates the scanning signal lines G1 to Gn based on the control signal C2. The data signal line drive circuit 3 drives the data signal lines S1 to Sm based on the control signal C3 and the correction video signal V. The common electrode drive circuit 4 applies a common electrode voltage Vcom to the common electrode 7.

The polarity-reversing signal REV included in the control signal C3 is a signal that indicates the polarity of the voltage applied to the data signal lines S1 to Sm, and switches between high and low levels every line period (or every several line periods). When the polarity-reversing signal REV is at low level, the data signal line drive circuit 3 applies a voltage higher than the common electrode voltage Vcom (hereinafter, referred to as a "positive polarity voltage") to the data signal lines S1 to Sm based on the correction video signal V. On the other hand, when the polarity-reversing signal REV is at high level, the data signal line drive circuit 3 applies a voltage lower than the common electrode voltage Vcom (hereinafter, referred to as a "negative polarity voltage") to the data signal lines S1 to Sm based on the correction video signal V. In such a manner, the data signal line drive circuit 3 applies the voltage corresponding to the correction video signal V to the data signal lines S1 to Sm, while switching the polarity every predetermined number of line periods. Thus, the liquid crystal display device shown in FIG. 1 performs line inversion drive.

Note that in the liquid crystal display device shown in FIG. 1, the common electrode drive circuit 4 may change the level of the common electrode voltage Vcom in accordance with the polarity-reversing signal REV. Concretely, the common electrode drive circuit 4 may control the common electrode voltage Vcom to be maintained at a relatively low level when the polarity-reversing signal REV is at low level, and at a relatively high level when the polarity-reversing signal REV is at high level.

The details of the correcting circuit 10 will be described below. The correcting circuit 10 includes a frame memory 11, a look-up table 12, and a correction process portion 13, as shown in FIG. 1. The frame memory 11 has a capacity to store a video signal of at least one frame, and stores at least one frame of the video signal X supplied from the signal source S. Hereinafter, the video signal supplied from the signal source S is referred to as the "current-frame video signal X", and the video signal stored in the frame memory 11 is referred to as the "previous-frame video signal Y".

The look-up table 12 has stored therein correction values emphasizing temporal signal change, in association with combinations of values for the video signal, as well as voltage polarities. The look-up table 12 includes a positive polarity table and a negative polarity table, as shown in FIG. 1.

FIGS. 2A and 2B are diagrams showing configuration examples of the look-up table 12. In these examples, the video signal X supplied from the signal source S takes a value from 0 to 255. The positive polarity table has stored therein correction values $P_{X,Y}$ in association with combinations of values for the current-frame video signal X and the previous-frame video signal Y, as shown in FIG. 2A. The negative polarity table has stored therein correction values $N_{X,Y}$ in association with combinations of values for the current-frame video signal X and the previous-frame video signal Y, as shown in FIG. 2B.

The correction values $P_{X,Y}$ and $N_{X,Y}$ are both correction values emphasizing the temporal signal change. Specifically, $P_{X,Y}=N_{X,Y}=X$ when X=Y; $P_{X,Y}\geqq X$ and $N_{X,Y}\geqq X$ when X>Y; and $P_{X,Y}\leqq X$ and $N_{X,Y}\leqq X$ when X<Y. In addition, when comparing the correction values $P_{X,Y}$ and $N_{X,Y}$, the former is preferably a correction value that adds more emphasis on the temporal signal change. In other words, it is preferable to determine the contents of the look-up table 12 such that the relationship $P_{X,Y}\geqq N_{X,Y}\geqq X$ is established when X>Y, and the relationship $P_{X,Y}\leqq N_{X,Y}\leqq X$ is established when X<Y. The contents of the look-up table 12 are determined, for example, based on characteristics, experimental results, etc., regarding the response speed of the pixels 6.

The correction process portion 13 receives the current-frame video signal X and the previous-frame video signal Y, along with the polarity-reversing signal REV outputted from the display control circuit 1 to the data signal line drive circuit 3. The correction process portion 13 executes the process shown in FIG. 3 based on these input signals.

First, the correction process portion 13 reads a correction value from the look-up table 12 by using the current-frame video signal X, the previous-frame video signal Y, and the polarity-reversing signal REV as an address (step S11). In step S11, the correction value $P_{X,Y}$ is read from the positive polarity table within the look-up table 12 when the polarity-reversing signal REV is at low level, whereas the correction value $N_{X,Y}$ is read from the negative polarity table within the look-up table 12 when the polarity-reversing signal REV is at high level. Next, the correction process portion 13 outputs the correction value being read in step S11 as a correction video signal V (step S12).

In this manner, when obtaining the correction video signal V by performing correction for emphasizing the temporal signal change on the video signal X supplied from the signal source S, the correcting circuit 10 differentially performs the correction in accordance with the polarity of the voltage applied to the data signal lines S1 to Sm.

Figure 13:
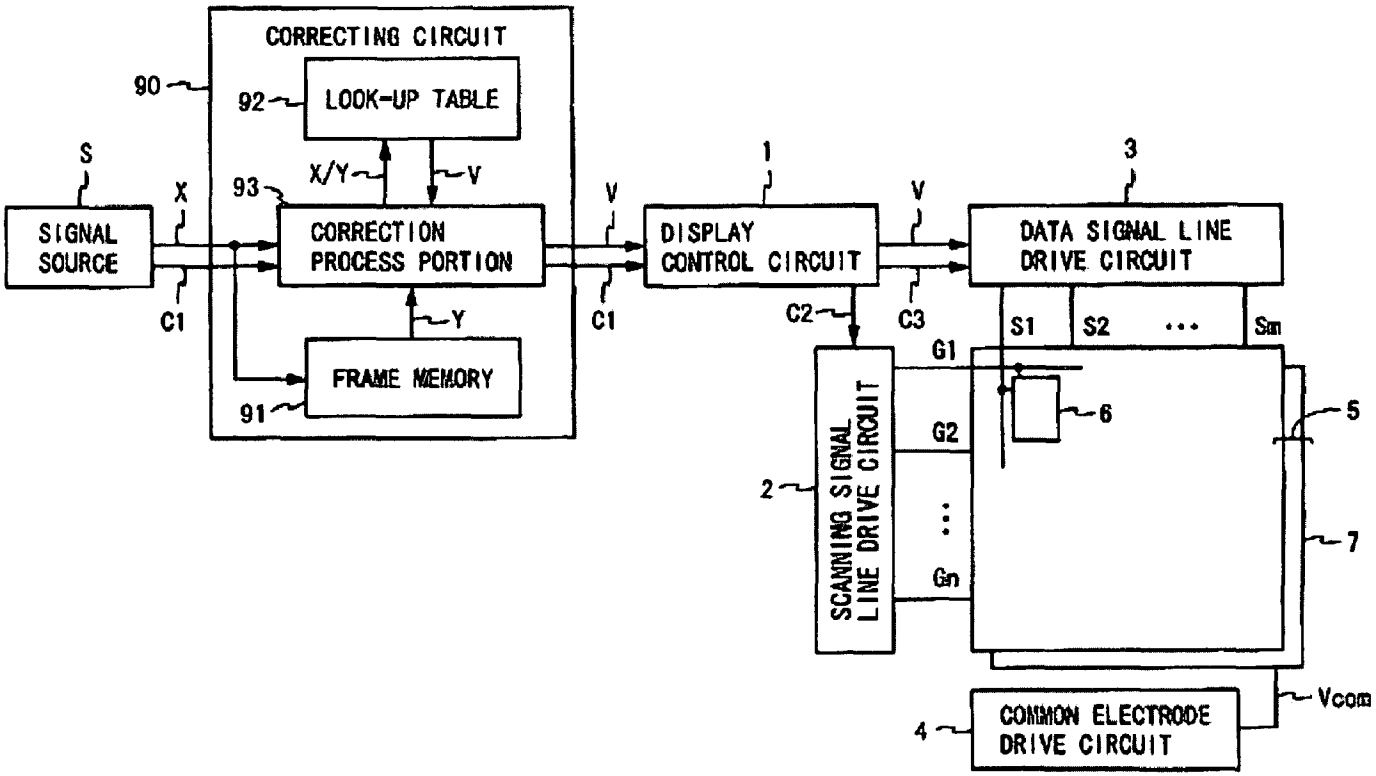
Fig. 13 PRIOR ART
FIG. 13 is a block diagram illustrating the configuration of a conventional liquid crystal display device.
Figure 14A:
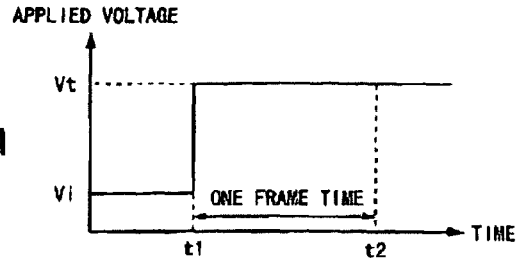
PRIOR ART Fig. 14A
FIG. 14A is a graph showing the applied voltage in the case where overshoot drive is not performed.
Figure 14B:
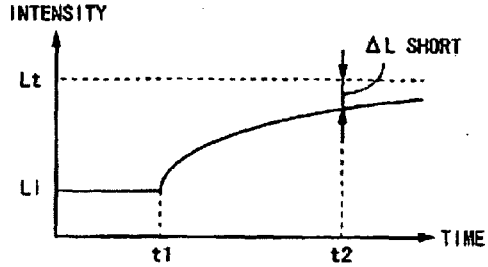
FIG. 14B is a graph showing the change in intensity in the case where overshoot drive is not performed.
Figure 14C:
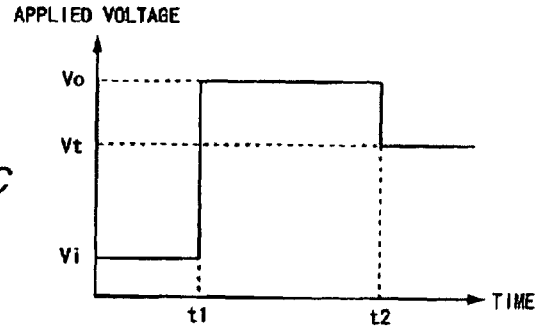
FIG. 14C is a graph showing the applied voltage in the case where overshoot drive is performed.
Figure 14D:
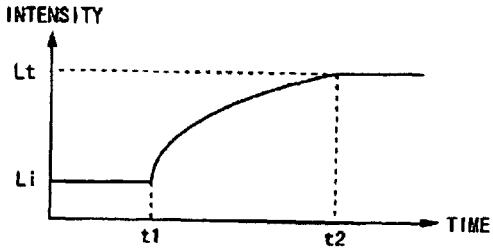
FIG. 14D is a graph showing the change in intensity in the case where overshoot drive is performed.
Figures 16, 17:
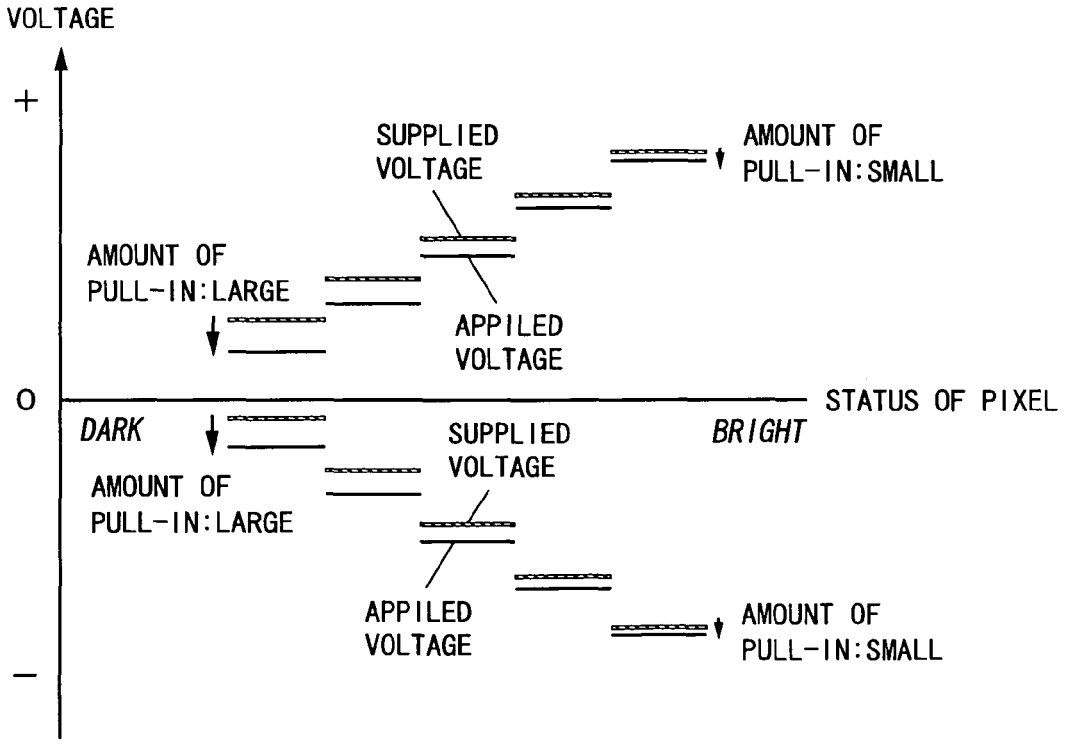
FIG. 16 is a diagram showing the tendency of pixel brightness for a portion of the pixels within the display screen as shown in FIGS. 15A and 15B.
FIG. 17 is a graph showing supplied voltages and applied voltages in a liquid crystal display device.

Effects of the liquid crystal display device according to the present embodiment will be described below in comparison with conventional liquid crystal display devices. As described above, in the case of conventional liquid crystal display devices that perform line inversion drive (FIG. 13), bright and dark fringes are generated on the display screen while displaying moving images due to the polarity of the applied voltage changing line by line (see FIG. 16).

On the other hand, in the case of the liquid crystal display device according to the present embodiment, the correcting circuit 10 differentially performs correction in accordance with the polarity of the voltage applied to the data signal lines. More specifically, when the polarity of the voltage applied to the data signal lines is positive, the correcting circuit 10 performs the correction so as to emphasize the temporal signal change more than when the polarity of the voltage is negative. Accordingly, as shown in FIG. 4, for the pixels in the even-numbered rows to which the voltage with positive polarity has been applied so that their brightness is expected not to change sufficiently, the degree of overshoot is intensified to compensate for the change in brightness, whereas for the pixels in the odd-numbered rows to which the voltage with negative polarity has been applied so that their brightness is expected to change excessively, the degree of overshoot is reduced to keep down the change in brightness.

In such a manner, in the case of the liquid crystal display device according to the present embodiment, even when the pixel brightness does not change sufficiently, or does change excessively, depending on the polarity of the applied voltage, the degree of overshoot is controlled in accordance with the polarity of the applied voltage, making it possible to suitably control the change in pixel brightness regardless of the polarity of the applied voltage. Thus, it is possible to prevent any fringes from being generated while displaying moving images, thereby preventing any reduction in quality of the moving images being displayed. In addition, the correcting circuit 10 includes the correction process portion 13 for reading the correction value from the look-up table 12 and outputting it as the correction video signal V, and therefore it is possible to prevent any fringes from being generated when displaying moving images with a simple circuit configuration.

Figure 5:
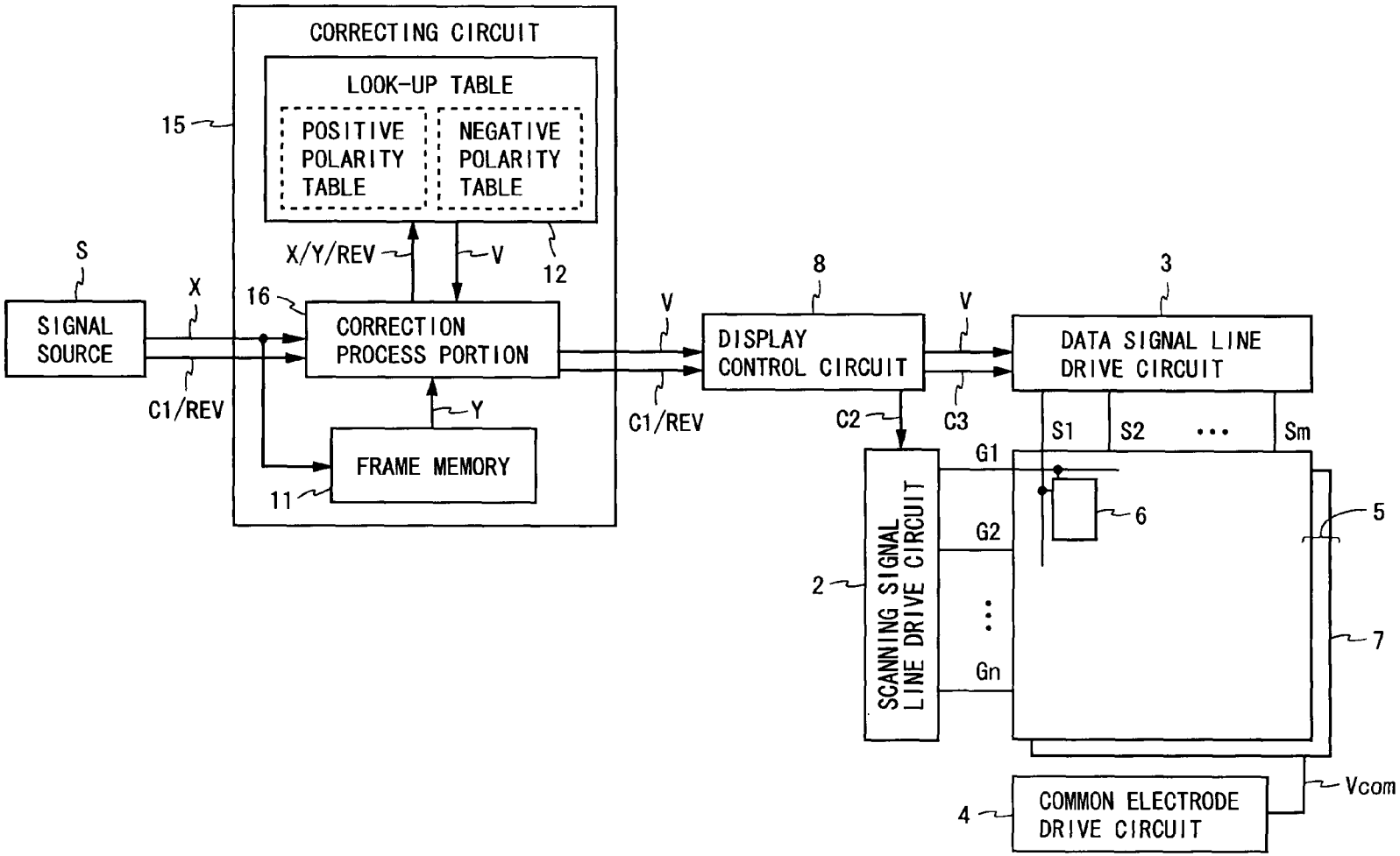
FIG. 5 is a block diagram illustrating the configuration of a liquid crystal display device according to a variant of the first embodiment of the present invention.

FIG. 5 is a block diagram illustrating the configuration of a liquid crystal display device according to a variant of the first embodiment of the present invention. The liquid crystal display device shown in FIG. 5 includes a display control circuit 8 and a correcting circuit 15, in place of the display control circuit 1 and the correcting circuit 10, respectively, of the liquid crystal display device shown in FIG. 1. The correcting circuit 15 includes a correction process portion 16, in place of the correction process portion 13 of the correcting circuit 10.

In FIG. 5, the signal source S supplies the video signal X, the control signal C1, and the polarity-reversing signal REV to the liquid crystal display device. The correction process portion 16 receives the current-frame video signal X and the previous-frame video signal Y, and also receives the polarity-reversing signal REV supplied from the signal source S along with the video signal. The correction process portion 16 executes the process shown in FIG. 3 based on these input signals.

The display control circuit 8 outputs the polarity-reversing signal REV supplied from the signal source S by way of the correcting circuit 15 to the data signal line drive circuit 3 after including the signal in the control signal C3 without any modification. The display control circuit 8 is operated in the same manner as the display control circuit 1 except for the point described above.

The liquid crystal display device according to such a variant makes it possible to prevent any fringes from being generated while displaying moving images as in the case of the liquid crystal display device according to the first embodiment.

(Second Embodiment)

Figure 6:
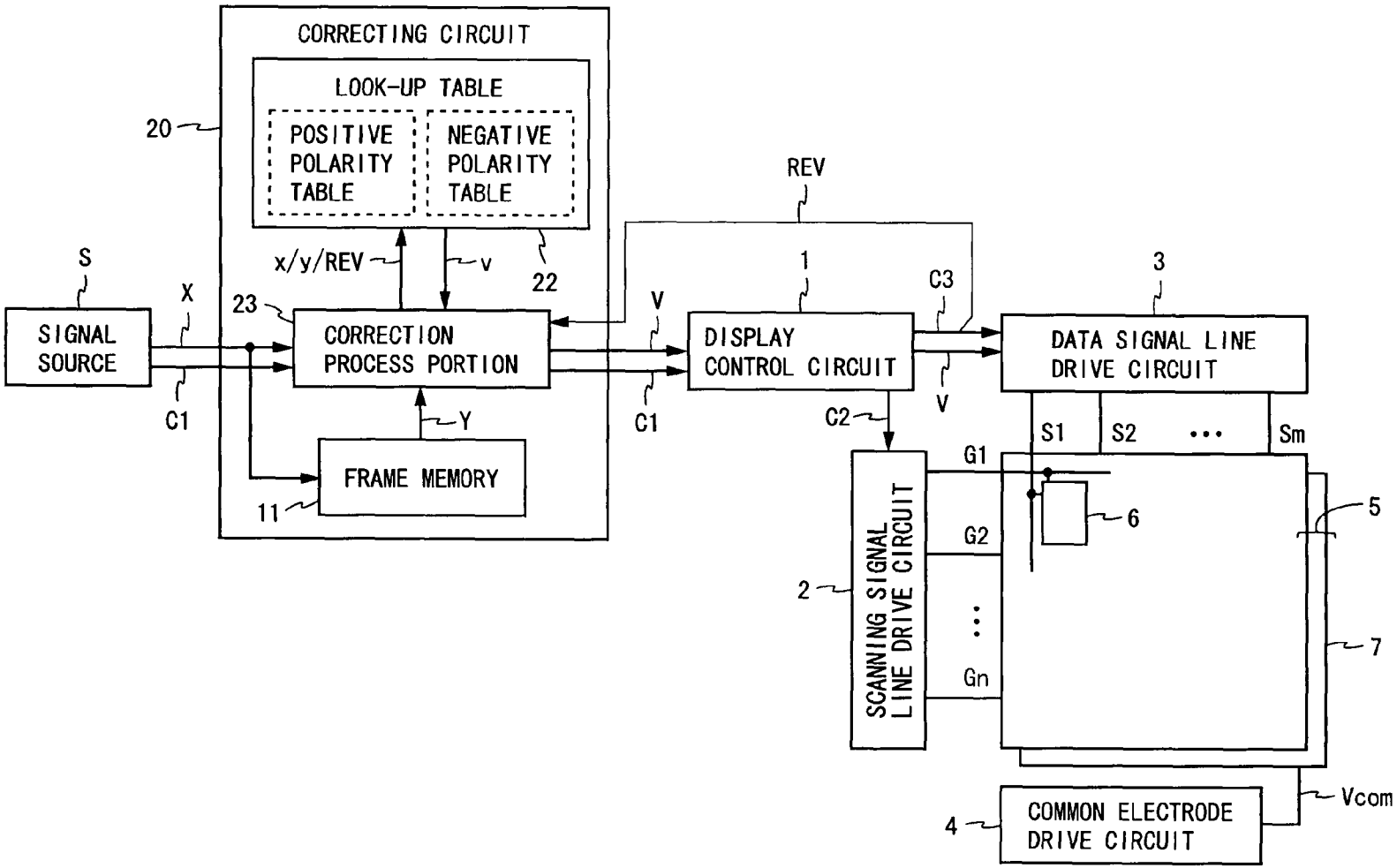
FIG. 6 is a block diagram illustrating the configuration of a liquid crystal display device according to a second embodiment of the present invention.

FIG. 6 is a block diagram illustrating the configuration of a liquid crystal display device according to a second embodiment of the present invention. The liquid crystal display device shown in FIG. 6 includes a correcting circuit 20, in place of the correcting circuit 10 of the liquid crystal display device according to the first embodiment. In the present embodiment, the same elements as those in the first embodiment are denoted by the same reference characters, and any descriptions thereof will be omitted.

The correcting circuit 20 includes a frame memory 11, a look-up table 22, and a correction process portion 23. The look-up table 22 has a reduced amount of data compared to the look-up table 12 according to the first embodiment, and has stored therein correction values emphasizing the temporal signal change, in association with combinations of value ranges for the video signal, as well as voltage polarities. The look-up table 22 includes a positive polarity table and a negative polarity table, as shown in FIG. 6.

FIGS. 7A and 7B are diagrams showing configuration examples of the look-up table 22. In these examples, the video signal X supplied from the signal source S takes a value from 0 to 255, the upper 5 bits of the current-frame video signal X are each set to x, and the upper 3 bits of the previous-frame video signal Y are each set to y. The positive polarity table has stored therein correction values $P_{x,y}$ in association with combinations of values for x and y, as shown in FIG. 7A. The negative polarity table has stored therein correction values $N_{x,y}$ in association with combinations of values for x and y, as shown in FIG. 7B.

Figure 8:
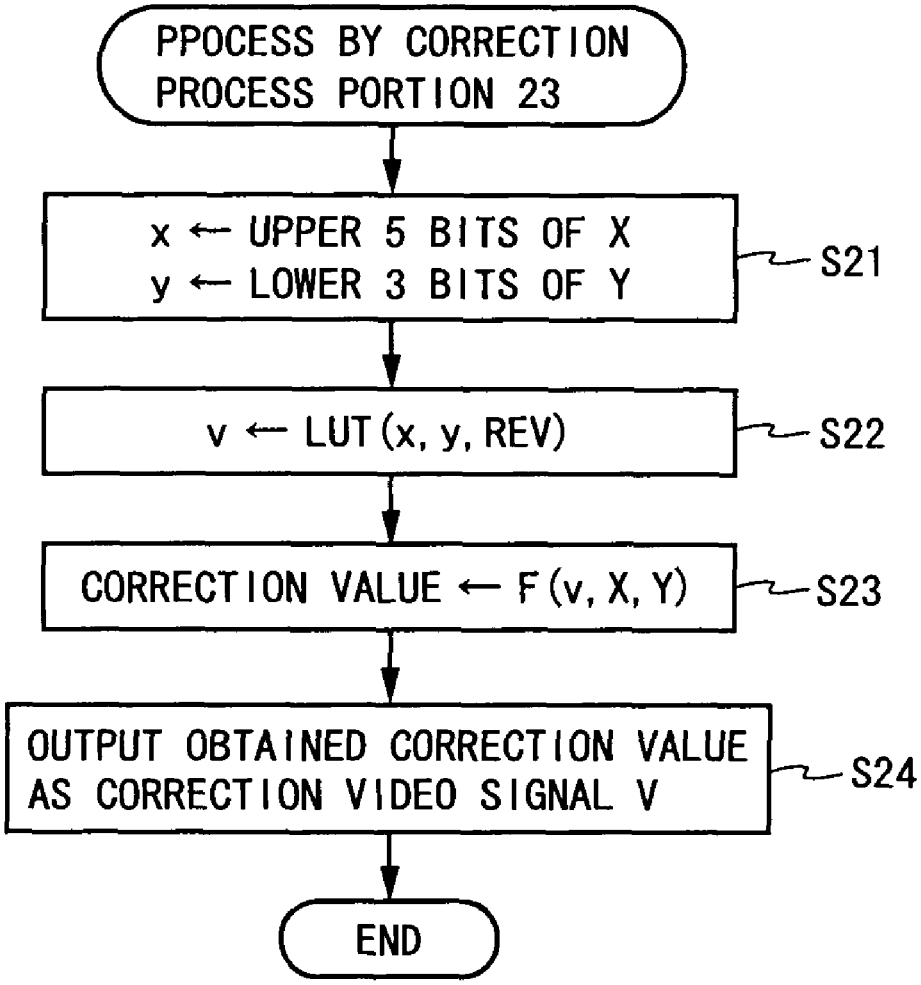
FIG. 8 is a flowchart illustrating a process by a correction process portion shown in FIG. 6.

The correction process portion 23 receives the current-frame video signal X and the previous-frame video signal Y, and also receives the polarity-reversing signal REV outputted from the display control circuit 1 to the data signal line drive circuit 3. The correction process portion 23 executes the process shown in FIG. 8 based on these input signals.

First, the correction process portion 23 sets each of the upper 5 bits of the current-frame video signal X to x, and each of the upper 3 bits of the previous-frame video signal Y to y (step S21). Next, the correction process portion 23 reads a correction value v from the look-up table 22 using x, y, and the polarity-reversing signal REV as an address (step S22). In step S22, the correction value $P_{x,y}$ is read from the positive polarity table within the look-up table 22 when the polarity-reversing signal REV is at low level, whereas the correction value $N_{x,y}$ is read from the negative polarity table within the look-up table 22 when the polarity-reversing signal REV is at high level.

Next, the correction process portion 23 performs a predetermined operation F on the correction value v being read in step S22, the current-frame video signal X, and the previous-frame video signal Y, thereby obtaining a correction value (step S23). Subsequently, the correction process portion 23 outputs the correction value obtained in step S23 as a correction video signal V (step S24).

The correction value obtained in step S23 is taken as P when the polarity-reversing signal REV is at low level, and as N when the polarity-reversing signal REV is at high level. The correction values P and N are both correction values emphasizing the temporal signal change. Specifically, $P=N=X$ when $X=Y$; $P \geqq X$ and $N \geqq X$ when $X>Y$; and $P \leqq X$ and $N \leqq X$ when $X<Y$. In addition, when comparing the correction values P and N, the former is preferably a correction value that adds more emphasis on the temporal signal change. In other words, the contents of the look-up table 22 and the details of the operation F are preferably determined such that the relationship $P \geqq N \geqq X$ is established when $X>Y$, and the relationship $P \leqq N \leqq X$ is established when $X<Y$. The contents of the look-up table 22 and the details of the operation F are determined based on, for example, characteristics, experimental results, etc., regarding the response speed of the pixels 6.

In this manner, when obtaining the correction video signal V by performing the correction for emphasizing the temporal signal change on the video signal X supplied from the signal source S, the correcting circuit 20 differentially performs the correction in accordance with the polarity of the voltage applied to the data signal lines S1 to Sm as in the case of the correcting circuit 10 according to the first embodiment.

Accordingly, the liquid crystal display device according to the second embodiment makes it possible to prevent any fringes from being generated while displaying moving images as in the case of the liquid crystal display device according to the first embodiment. In particular, the correcting circuit 20 includes the look-up table 22 having stored therein the correction values emphasizing the temporal signal change in association with combinations of value ranges for the video signal, and also includes the correction process portion 23 that subjects the correction value being read from the look-up table 22 to the operation F and outputs it as the correction video signal V, and therefore it is possible to prevent any fringes from being generated while displaying moving images, although the size of the look-up table 22 is reduced. Note that the same variant as in the first embodiment can be configured for the second embodiment.

(Third Embodiment)

Figure 9:
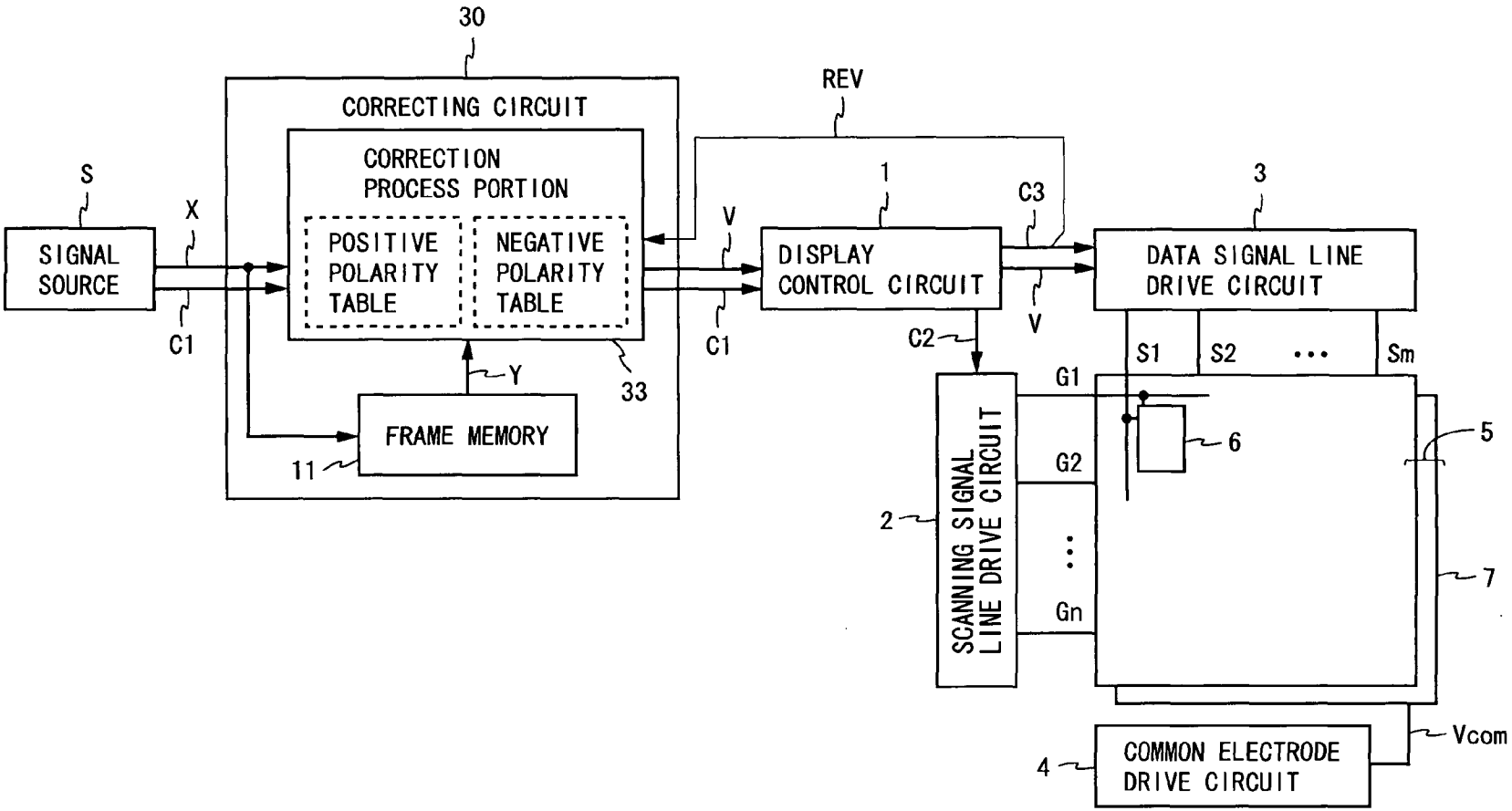
FIG. 9 is a block diagram illustrating the configuration of a liquid crystal display device according to a third embodiment of the present invention.

FIG. 9 is a block diagram illustrating the configuration of a liquid crystal display device according to a third embodiment of the present invention. The liquid crystal display device shown in FIG. 9 includes a correcting circuit 30, in place of the correcting circuit 10 of the liquid crystal display device according to the first embodiment. In the present embodiment, the same elements as those in the first embodiment are denoted by the same reference characters, and any descriptions thereof will be omitted.

Figure 10:
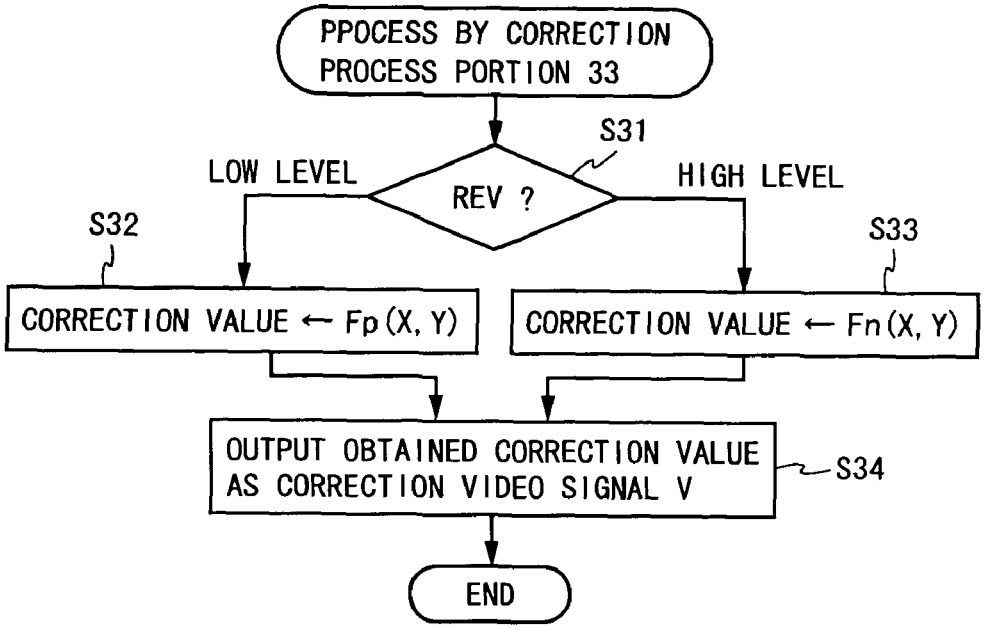
FIG. 10 is a flowchart illustrating a process by a correction process portion shown in FIG. 9.

The correcting circuit 30 includes a frame memory 11, and a correction process portion 33. The correction process portion 33 receives the current-frame video signal X and the previous-frame video signal Y, and also receives the polarity-reversing signal REV outputted from the display control circuit 1 to the data signal line drive circuit 3. The correction process portion 33 executes the process shown in FIG. 10 based on these input signals.

First, the correction process portion 33 determines whether the polarity-reversing signal REV is at low or high level (step S31). The correction process portion 33 performs a correcting operation Fp for positive polarity on the current-frame video signal X and the previous-frame video signal Y when the polarity-reversing signal REV is at low level, thereby obtaining a correction value (step S32). On the other hand, the correction process portion 33 performs a correcting operation Fn for negative polarity on the current-frame video signal X and the previous-frame video signal Y when the polarity-reversing signal REV is at high level, thereby obtaining a correction value (step S33). Next, the correction process portion 33 outputs the correction value obtained in step S32 or S33 as a correction video signal V (step S34).

The correction value obtained in step S32 when the polarity-reversing signal REV is at low level is taken as P, whereas the correction value obtained in step S33 when the polarity-reversing signal REV is at high level is taken as N. The correction values P and N are both correction values emphasizing the temporal signal change. Specifically, $P=N=X$ when $X=Y$; $P \geqq X$ and $N \geqq X$ when $X>Y$; and $P \leqq X$ and $N \leqq X$ when $X<Y$. In addition, when comparing the correction values P and N, the former is preferably a correction value that adds more emphasis on the temporal signal change. In other words, the details of the correcting operations Fp and Fn are preferably determined such that the relationship $P \geqq N \geqq X$ is established when $X>Y$, and the relationship $P \leqq N \leqq X$ is established when $X<Y$. The details of the correcting operations Fp and Fn are determined based on, for example, characteristics, experimental results, etc., regarding the response speed of the pixels 6.

In such a manner, when obtaining the correction video signal V by performing the correction for emphasizing the temporal signal change on the video signal X supplied from the signal source S, the correcting circuit 30 differentially performs the correction in accordance with the polarity of the voltage applied to the data signal lines S1 to Sm as in the case of the correcting circuit 10 according to the first embodiment.

Accordingly, the liquid crystal display device according to the third embodiment makes it possible to prevent any fringes from being generated while displaying moving images as in the case of the liquid crystal display device according to the first embodiment. In particular, the correcting circuit 30 includes the correction process portion 33 that differentially performs the correcting operation in accordance with the polarity of the applied voltage, and therefore it is possible to prevent any fringes from being generated while displaying moving images without using any look-up table. Note that the same variant as in the first embodiment can also be configured for the third embodiment.

Figure 11A:
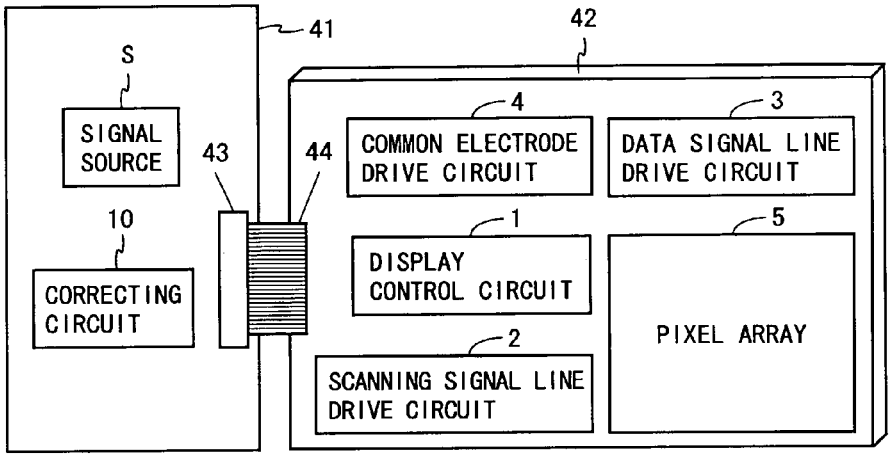
FIG. 11A is a diagram showing a mounting example of the liquid crystal display device shown in FIG. 1.
Figure 11B:
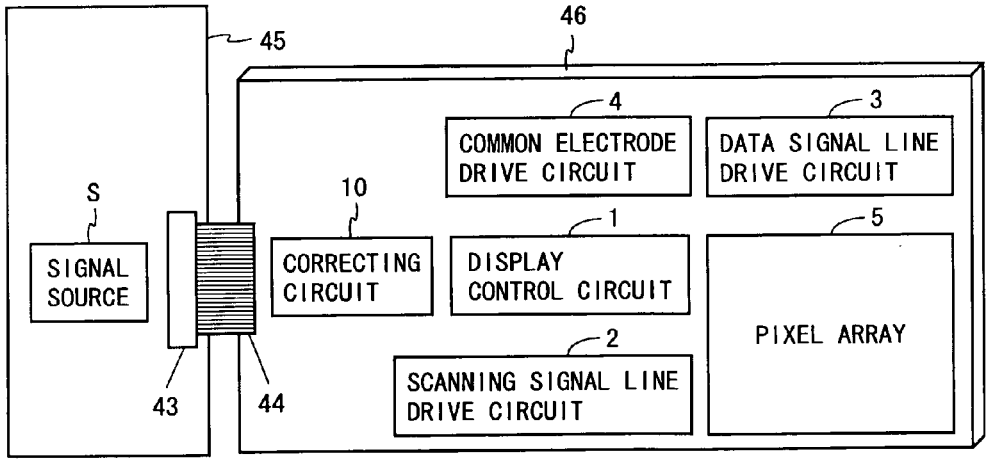
FIG. 11B is a diagram showing another mounting example of the liquid crystal display device shown in FIG. 1.

Mounting forms of the liquid crystal display devices according to the embodiments of the present invention will be described below. FIGS. 11A and 11B are diagrams showing mounting examples of the liquid crystal display device according to the first embodiment of the present invention. In the example shown in FIG. 11A, the correcting circuit 10 is provided in a main unit 41, along with the signal source S, and other elements are provided in a liquid crystal display module 42. The main unit 41 and the liquid crystal display module 42 are connected by a connector 43 and a flat cable 44. In the example shown in FIG. 11B, the signal source S is provided in a main unit 45, but all elements of the liquid crystal display device, including the correcting circuit 10, are provided in a liquid crystal display module 46.

In such a manner, as for the liquid crystal display device according to the first embodiment, the correcting circuit 10 may be provided in the main unit or in the liquid crystal display module. The same can be applied to the liquid crystal display devices according to the second and third embodiments, and also to liquid crystal display devices according to variants of the embodiments.

Figure 12:
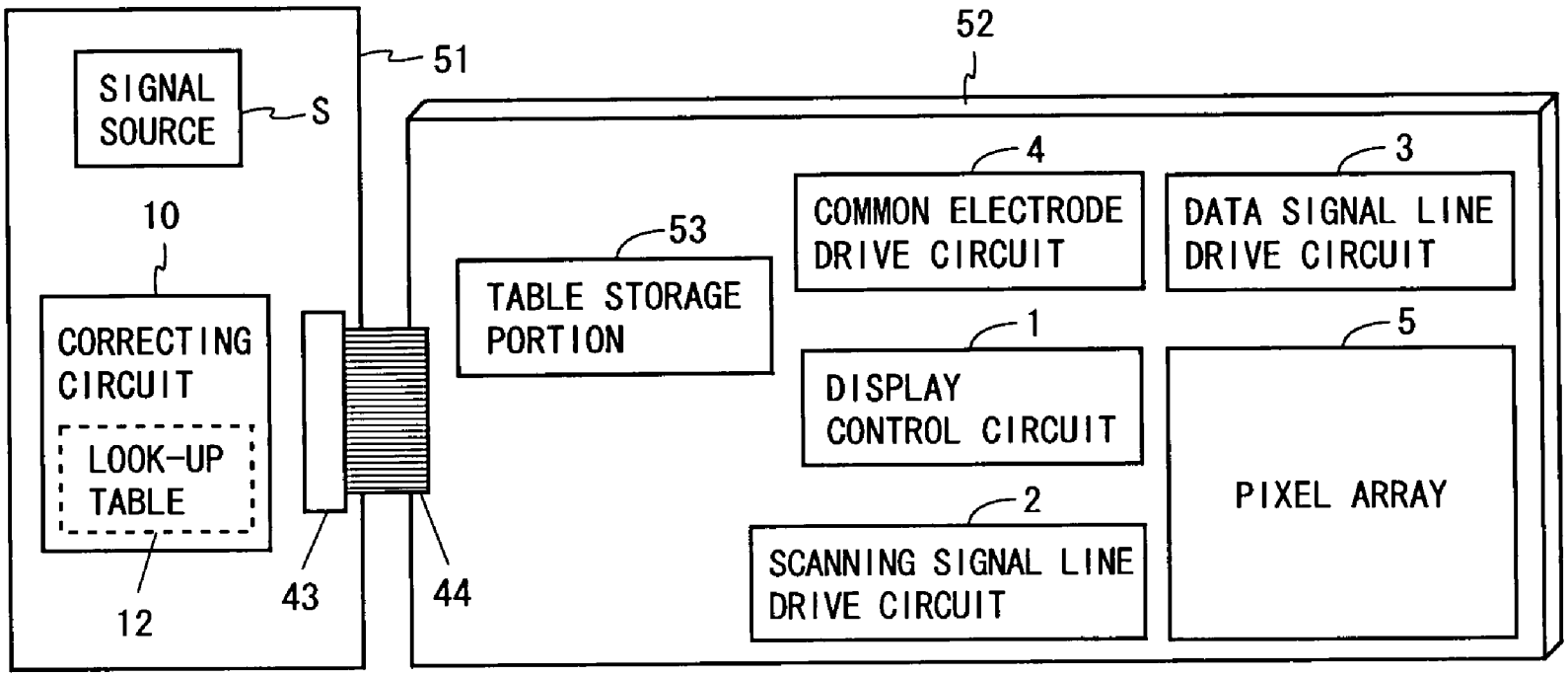
FIG. 12 is a diagram showing another mounting example of the liquid crystal display device shown in FIG. 1.

FIG. 12 is a diagram showing another mounting example of the liquid crystal display device according to the first embodiment of the present invention. In the example shown in FIG. 12, the correcting circuit 10 is provided in a main unit 51, along with the signal source S, and other elements are provided in a liquid crystal display module 52. Also, a table storage portion 53 is additionally provided in the liquid crystal display module 52. The table storage portion 53 has plural types of correction values for use in overshoot drive stored therein in a non-volatile manner. Based on operating conditions (e.g., operating temperature, etc.) of the liquid crystal display device, one of the plural types of correction values stored in the table storage portion 53 is selected and transferred to the look-up table 12 in the correcting circuit 10.

In such a manner, by mounting the liquid crystal display device according to the first embodiment in the form shown in FIG. 12, it becomes possible to perform suitable overshoot drive in accordance with the operating conditions by changing the correction value stored in the look-up table 12 in accordance with the operating conditions. The same can be applied to the liquid crystal display device according to the second embodiment, and also to the liquid crystal display devices according to the variants of the first and second embodiments. Note that the table storage portion 53 may be provided in the main unit, rather than in the liquid crystal display module. For example, it is also possible to use as the table storage portion 53 a flash memory that has already been provided in the liquid crystal display module or the main unit in order to store various parameters used for controlling the liquid crystal display module.

Also, in the liquid crystal display device according to each embodiment, the correcting circuit may be mounted in any form so long as it differentially performs the correction in accordance with the polarity of the voltage applied to the data signal lines S1 to Sm when obtaining the correction video signal V by performing the correction for emphasizing the temporal signal change on the video signal X supplied to the signal source S. For example, the correcting circuit including the frame memory, the look-up table, and the correction process portion may be provided in a single semiconductor chip, or these three elements may be included in their respective different semiconductor chips. Alternatively, any one or all of the three elements may be provided in the same semiconductor chip as another element of the liquid crystal display device (e.g., the display control circuit 1).

While the foregoing has been described with respect to the case where the correcting circuit changes the details of the correction based on the polarity-reversing signal REV supplied from the display control circuit 1 or the signal source S, the correcting circuit may change the details of the correction at any arbitrary self-determined time without using the polarity-reversing signal REV. In order to achieve this, the correcting circuit may estimate the time at which the polarity-reversing signal REV changes based on the control signal C1 supplied from the signal source S assuming that the polarity-reversing signal REV changes in constant cycles after initialization, so that the details of the correction are changed at the estimated time.

Industrial Applicability

The present invention makes it possible to prevent any fringes from being generated while displaying moving images, and therefore can be employed in various liquid crystal display devices that perform line inversion drive.

The invention claimed is:

1. A liquid crystal display device that performs line inversion drive, comprising:

a pixel array including a plurality of pixels disposed in row and column directions, a plurality of scanning signal lines each commonly connected to the pixels disposed in the same row, and a plurality of data signal lines each commonly connected to the pixels disposed in the same column;

a correcting circuit for obtaining a correction video signal by storing a video signal supplied from a signal source and performing correction for emphasizing temporal signal change between frames on the supplied video signal;

a scanning signal line drive circuit for sequentially selecting and activating the scanning signal lines; and a data signal line drive circuit for applying a voltage corresponding to the correction video signal to the data signal lines, while changing its polarity every number of line periods, wherein the correcting circuit performs a first correction for emphasizing the temporal signal change when the polarity of the voltage applied to the data signal line is positive and performs a second correction for emphasizing the temporal signal change when the polarity of the voltage applied to the data signal line is negative, and the first and second correction includes modifying a value of a current frame of the supplied video signal such that the temporal signal change is emphasized, when the value of the current frame is greater than a value of a previous frame, then an amount that the value of the current frame is modified using the first correction is greater than to an amount that the value of the current frame is modified using the second correction, and when the value of the current frame is less than the value of the previous frame, then the amount that the value of the current frame is modified using the first correction is less than to an amount that the value of the current frame is modified using the second correction.

2. The liquid crystal display device according to claim 1, wherein the correcting circuit includes:

a storage portion for storing a video signal of at least one frame;

a conversion table having stored therein correction values emphasizing the temporal signal change in association with combinations of values for the video signal, as well as voltage polarities; and a correction process portion for reading a correction value from the conversion table and outputting the correction value being read as the correction video signal based on a current-frame video signal supplied from the signal source, a previous-frame video signal stored in the storage portion, and the polarity of the voltage applied to the data signal lines.

3. The liquid crystal display device according to claim 1, wherein the correcting circuit includes:

a storage portion for storing a video signal of at least one frame;

a conversion table having stored therein correction values emphasizing the temporal signal change in association with combinations of value ranges for the video signal, as well as voltage polarities; and a correction process portion for reading a correction value from the conversion table and outputting a result obtained by subjecting the correction value being read to a operation as the correction video signal, based on a current-frame video signal supplied from the signal source, a previous-frame video signal stored in the storage portion, and the polarity of the voltage applied to the data signal lines.

4. The liquid crystal display device according to claim 1, wherein the correcting circuit includes:

a storage portion for storing a video signal of at least one frame; and a correction process portion for performing a correcting operation to emphasize the temporal signal change based on a current-frame video signal supplied from the signal source and a previous-frame video signal stored in the storage portion, and wherein the correction process portion differentially performs the correcting operation in accordance with the polarity of the voltage applied to the data signal lines.

5. The liquid crystal display device according to claim 1, further comprising a display control circuit for outputting a control signal to the scanning signal line drive circuit and the data signal line drive circuit, wherein the correcting circuit differentially performs the correction in accordance with a polarity-reversing signal outputted from the display control circuit to the data signal line drive circuit.

6. The liquid crystal display device according to claim 1, wherein the correcting circuit differentially performs the correction in accordance with a polarity-reversing signal supplied from the signal source, along with the video signal.

7. A method for driving a liquid crystal display device provided with a pixel array including a plurality of pixels disposed in row and column directions, a plurality of scanning signal lines each commonly connected to the pixels disposed in the same row, and a plurality of data signal lines each commonly connected to the pixels disposed in the same column, the method comprising the steps of:

obtaining a correction video signal by storing a video signal supplied from a signal source and performing correction for emphasizing temporal signal change between frames on the supplied video signal;

sequentially selecting and activating the scanning signal lines; and applying a voltage corresponding to the correction video signal to the data signal lines, while changing its polarity every number of line periods, wherein in the step of obtaining the correction video signal, a first correction for emphasizing the temporal signal change is performed when the polarity of the voltage applied to the data signal line is positive and a second correction for emphasizing the temporal signal change is performed when the polarity of the voltage applied to the data signal line is negative, and the first and second correction includes modifying a value of a current frame of the supplied video signal such that the temporal signal change is emphasized, when the value of the current frame is greater than a value of a previous frame, then an amount that the value of the current frame is modified using the first correction is greater than an amount that the value of the current frame is modified using the second correction, and when the value of the current frame is less than the value of the previous frame, then the amount that the value of the current frame is modified using the first correction is less than the amount that the value of the current frame is modified using the second correction.

* * * * *